United States Patent [19]

Ciekurs

[11] Patent Number: 4,548,120

[45] Date of Patent: Oct. 22, 1985

[54] EXTERNALLY POWERED SEPARATE LOADED AMMUNITION CANNON

[75] Inventor: Richard Ciekurs, New Providence, N.J.

[73] Assignee: The United States of America as represented by the Secretary of the Army, Washington, D.C.

[21] Appl. No.: 562,350

[22] Filed: Dec. 16, 1983

[51] Int. Cl.[4] ..... F41F 9/10

[52] U.S. Cl. ..... 89/11; 89/33.03

[58] Field of Search ..... 89/9, 11, 33.03, 155, 89/156, 157

[56] References Cited

U.S. PATENT DOCUMENTS

| | | | |
|---|---|---|---|
| 3,355,988 | 12/1967 | D'Andrea | 89/33.03 |
| 3,915,058 | 10/1975 | Folsom et al. | 89/172 |
| 4,240,324 | 12/1980 | Smith et al. | 89/156 |

*Primary Examiner*—Stephen C. Bentley

*Attorney, Agent, or Firm*—Anthony T. Lane; Robert P. Gibson; Michael C. Sachs

[57] ABSTRACT

An externally powered automatic cannon comprises a receiver, a barrel connected to the receiver and having a bore with a rear end opening toward the receiver, a chamber member having a chamber for a propellant case movable in the chamber and a cam drum rotatable on the receiver and engaged with the chamber member for moving the chamber member from an operating position with the chamber aligned with the rear end of the bore, to a loading position with the chamber misaligned with the rear end of the bore and spaced therefrom. A projectile feeder with ram, rams a projectile into the now exposed rear end of the bore. At the same time a propellant case feeder with ram, rams a propellant casing to the opened chamber. Continued rotation of the cam drum returns the chamber member into its operating position at which time the propellant is ignited to propel the projectile down the barrel bore. The cycle is repeated with each rotation of the cam drum for rapid automatic firing of the cannon.

3 Claims, 16 Drawing Figures

EXTERNALLY POWERED SEPARATE LOADED AMMUNITION CANNON

GOVERNMENT INTEREST

The invention described herein may be manufactured, used and licensed by or for the Government for Government purposes without the payment to us of any royalties thereon.

FIELD AND BACKGROUND OF THE INVENTION

The present invention relates in general to automatic guns and in particular to a new and useful externally powered, separately loaded and high performance cannon.

Weapons designed to fire separately loaded ammunition, known as SLAmmo are known and disclosed for example in U.S. Pat. No. 4,240,324. This automatic gun utilizes energy produced by the exploding propellant to reload fresh charges and projectiles. Rates of fire and overall performance can be improved by externally powering such cannons.

SUMMARY OF THE INVENTION

The present invention is drawn to an externally powered automatic cannon mechanism. While the specific examples shown fire 30 mm caliber projectiles, the mechanism is scaleable from cal.50 up to 40 mm caliber.

Accordingly, an object of the present invention is to provide an externally powered automatic cannon which comprises a receiver, a barrel connected to the receiver and having a bore with a rear end opening toward the receiver for receiving a projectile, a chamber member having a chamber for receiving a propellant case and movable in the receiver from an operating position with the chamber aligned with the rear end opening of the barrel, to a loading position with the chamber misaligned and spaced from the rear end opening of the barrel. Projectile feed means are provided for feeding a plurality of projectiles, one at a time, into alignment with the rear end opening of the bore, projectile ram means for ramming a projectile which is aligned with the rear end opening into the rear end opening of the bore, case feed means for feeding a plurality of propellant cases, one at a time, into alignment with the chamber, and case ram means for ramming each aligned propellant casing into the chamber, with the chamber member in its loading position. External drive means are operatively connected to the ram means and to the chamber member. The drive means are cyclically movable on the receiver for repeatedly moving the chamber member into its operating and loading position, loading the propellant cases and projectiles into the respective chamber and bore, and returning the chamber member into its operating position for firing of the cannon.

Another object of the invention is to provide a method of externally powering an automatic cannon which comprises moving a chamber member having a chamber from a position of alignment between the chamber and a rear end opening of a barrel bore, to a loading position spaced from the barrel bore and misaligned therewith, loading a propellant case into the chamber, simultaneously loading a projectile into the bore, and thereafter returning the chamber member from its loading position to an operating position for firing of the cannon.

A still further object of the invention is to provide an externally powered high performance automatic cannon which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are disclosed.

DESCRIPTION OF THE PREFERRED EMBODIMENTS

Figure 1:
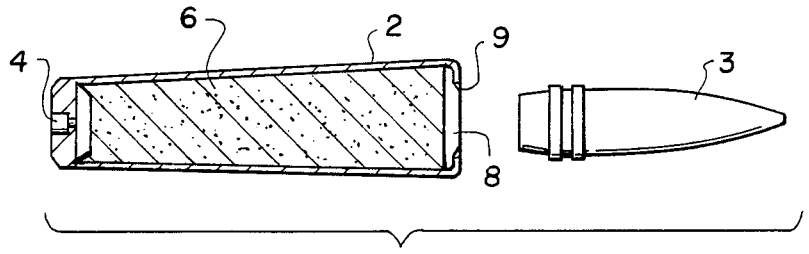
FIG. 1 is a side elevational view, partially in section showing separately loaded ammunition used in accordance with the invention.

Referring to the drawings in particular, the invention embodied therein is utilized to fire separately loaded ammunition illustrated in FIG. 1. This ammunition comprises a propellant case 2 made of aluminum or other suitable material such as brass, steel or plastic. The case has conventional base primer 4, a propellant charge 6 and end seal 8 and an annular crushable flange 9.

A separately loaded projectile 3 is of a conventional spin stabilized type. Essentially any type of finned stabilized, tubular, discarding sabot long rod penetrator or the like may be used however, as a projectile.

Figure 2:
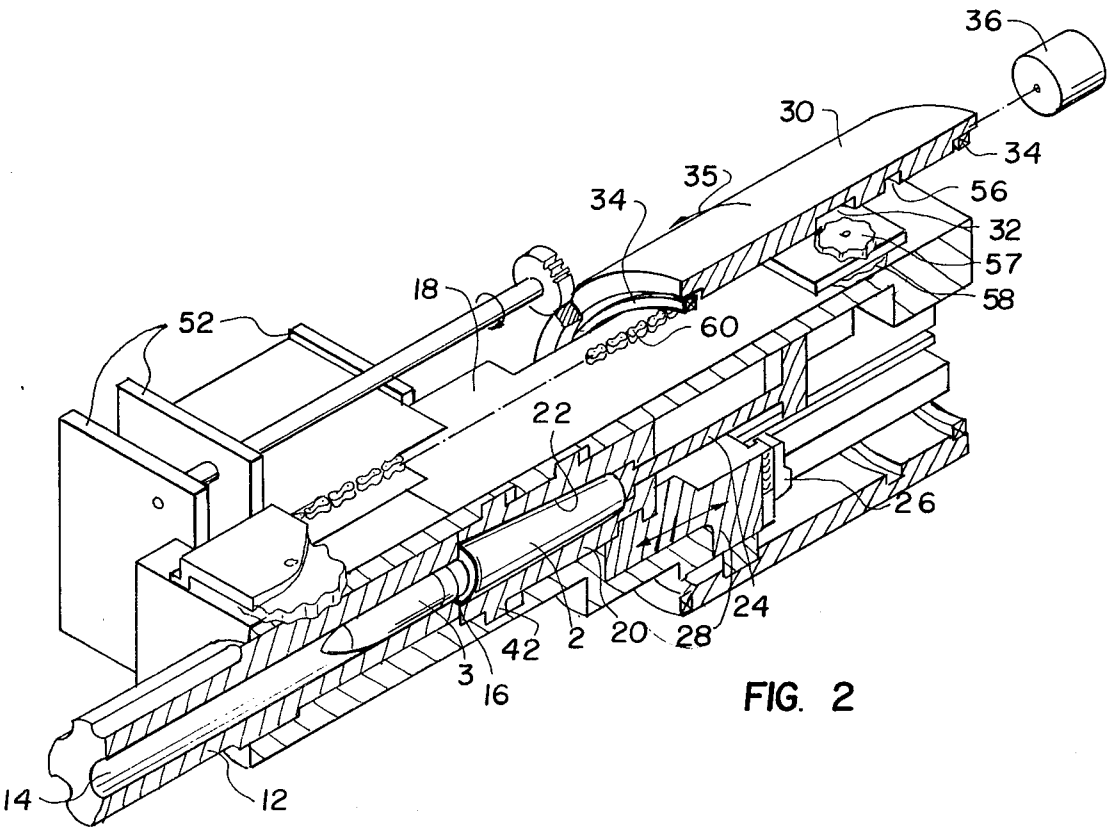
FIG. 2 is a front top perspective view with portions cut away of one embodiment of the automatic cannon mechanism in accordance with the invention.

Referring to FIG. 2, the cannon or weapon of the invention comprises a single-barrel, linkless-feed comprising a barrel 12 having a bore 14 with a rear end 16 opening toward a fixed receiver 18, to which the barrel is mounted. A projectile 3 is shown seated in the rear end opening of barrel 12. A movable chamber member 20 has a chamber 22 in which a propellant case 2 is held. The cannon mechanism is shown with chamber member 20 in its operating position just before firing. A bolt/ejector assembly 24 is provided at the rear end of chamber 22 and contains a firing pin for firing the propellant case 2.

Chamber member 20 is locked in its operating position by a lock 26 dovetailed and slidable vertically at the end of a cam follower 28 which engages chamber member 20. Cam follower 28 cooperates with the cam groove 32 of a cam drum 30. Cam drum 30 is rotatably mounted on receiver 18 by bearings 34. During the automatic operation of the cannon mechanism, cam drum 30 rotates continuously in the direction of arrow 35 by the action of a motor schematically shown at 36.

With each rotation of cam drum 30, cam follower 28 with its connected chamber member 20 executes a full cycle from the operating position shown in FIG. 2, to a loading position with chamber 20 spaced from and misaligned with rear end opening 16 of barrel bore 14, the ramming of a projectile forwardly into barrel bore 14 and a propellant case rearwardly into chamber 22, the return of chamber member 20 into its aligned operating position as shown in FIG. 2, the movement of lock 26 to lock chamber member 20 in its operating position and the firing of the propellant case.

Figure 3:
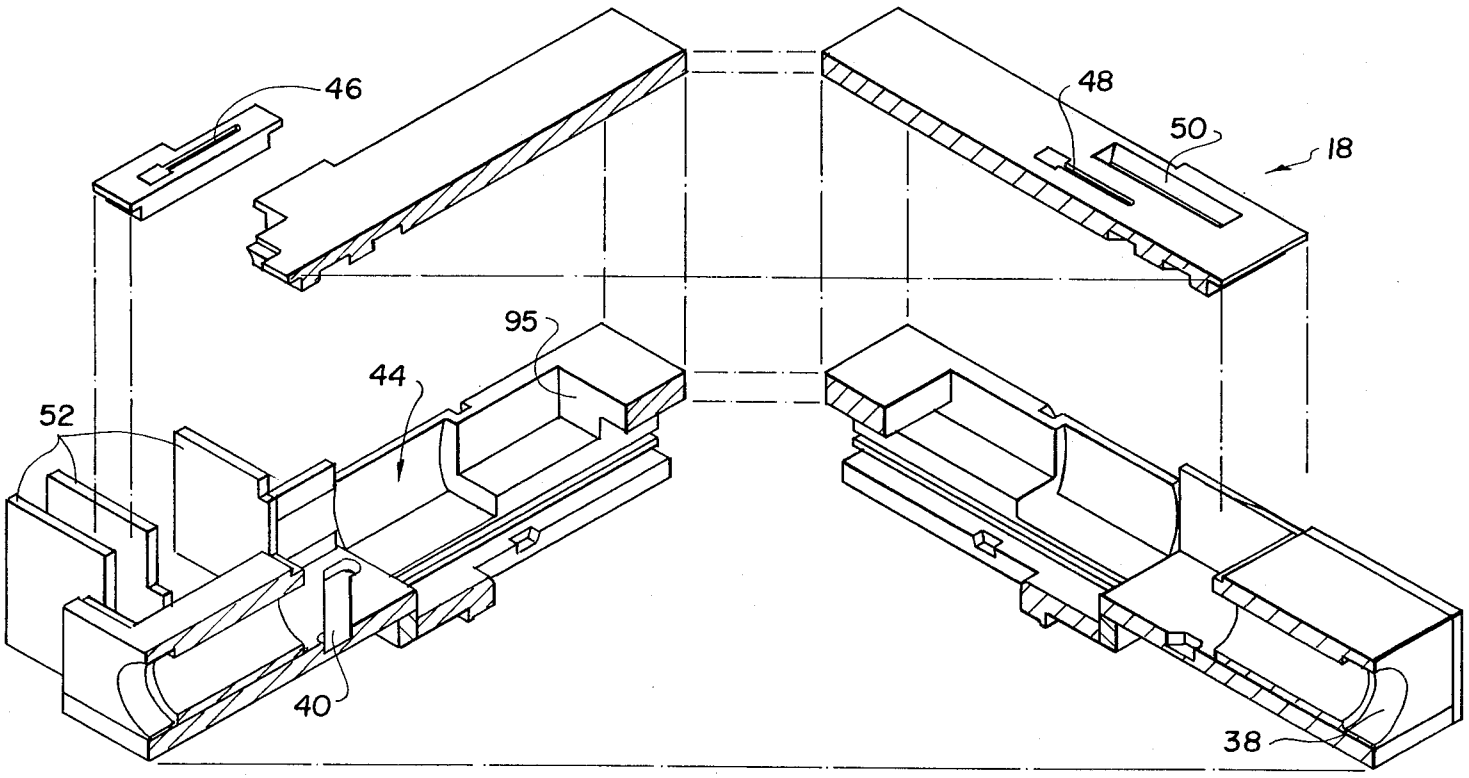
FIG. 3 is a front top perspective and exploded view of a receiver used in the embodiment of FIG. 2.

As shown in FIG. 3, receiver 18 (shown in exploded parts for clarity) has a forward bore 38 for receiving the rear end of bore 14, a cam groove 40 in which a downwardly extending projection 42 of chamber member 20 moves and a space 44 for accommodating the rearward and lateral movement of chamber member 20 with its cam follower 28. Two additional grooves not shown extend parallel to groove 40 for confining the movement of chamber member 20 between its operating and loading positions. The roof of receiver 18 includes a case ram slot 46 for receiving a rearwardly slidable pin which acts as a ram for ramming propellant cases into chamber 22, a projectile ram slot 48 serving the same purpose for a projectile ram and a projectile feed slot 50 for receiving a plurality of projectiles, one at a time, fed from above, to the rear end of barrel bore 14. Supports 52 are connected at one side of receiver 18 for supporting propellant case feed means to be described hereinunder. The propellant cases 2 are fed from the right side of the mechanism when viewed from the rear.

One of the advantages of the invention is that, upon a misfire of a propellant case 2, the case can be independently discharged from chamber 22 and a fresh propellant case inserted. During this time, the feeding of a projectile 3 is suppressed since a projectile is already seated in barrel 14.

Figure 4:
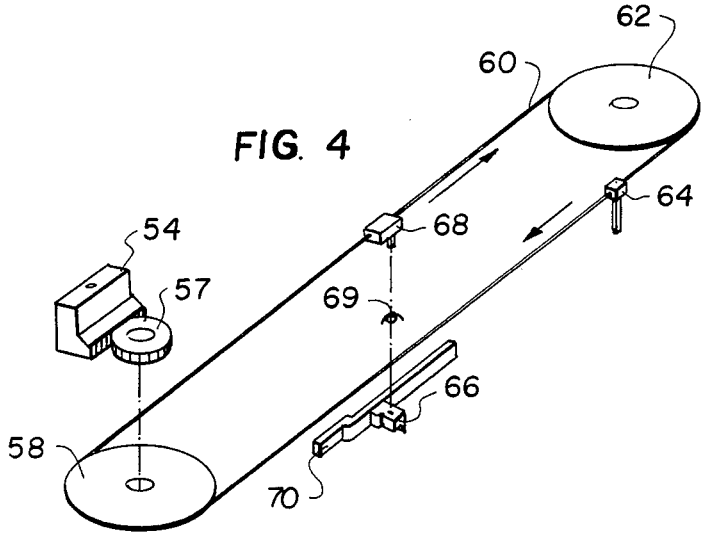
FIG. 4 is an exploded top rear perspective view of a chain driving arrangement for ramming the projectile and case.

FIG. 4 schematically illustrates a driving arrangement for ramming a propellant case and projectile. The arrangement which is viewed from the rear in FIG. 4, comprises a sliding cam follower 54 which moves along a longitudinal axis of the mechanism 10 by riding in a cam slot 56 of cam drum 30. Cam follower 54 has teeth which mesh with a drive gear 57. Drive gear 57 is fixed to a drive sprocket 58 which thus rotates with the rotation of drum 30. A drive chain 60 is trained around drive sprocket 58 and an idle sprocket 62 which are both rotatably mounted to the roof of receiver 18 as shown in FIG. 2. A case rammer in the form of a downwardly extending pin 64 is fixed to chain 60 and extends downwardly through slot 46 in the roof of receiver 18. A projectile rammer 66 is connected to chain 60 over a rammer slide 68 which pivotally receives rammer 66 and includes a biasing spring 69. Rammer 66 includes a projectile rammer cam surface 70 which cooperates with a cam surface in receiver 18 to position rammer 66 into its ramming position against the bias of spring 69. This arrangement permits the reverse movement of rammer 66 for clearing the bore area when chamber member 20 returns to its operating position.

Figure 5:
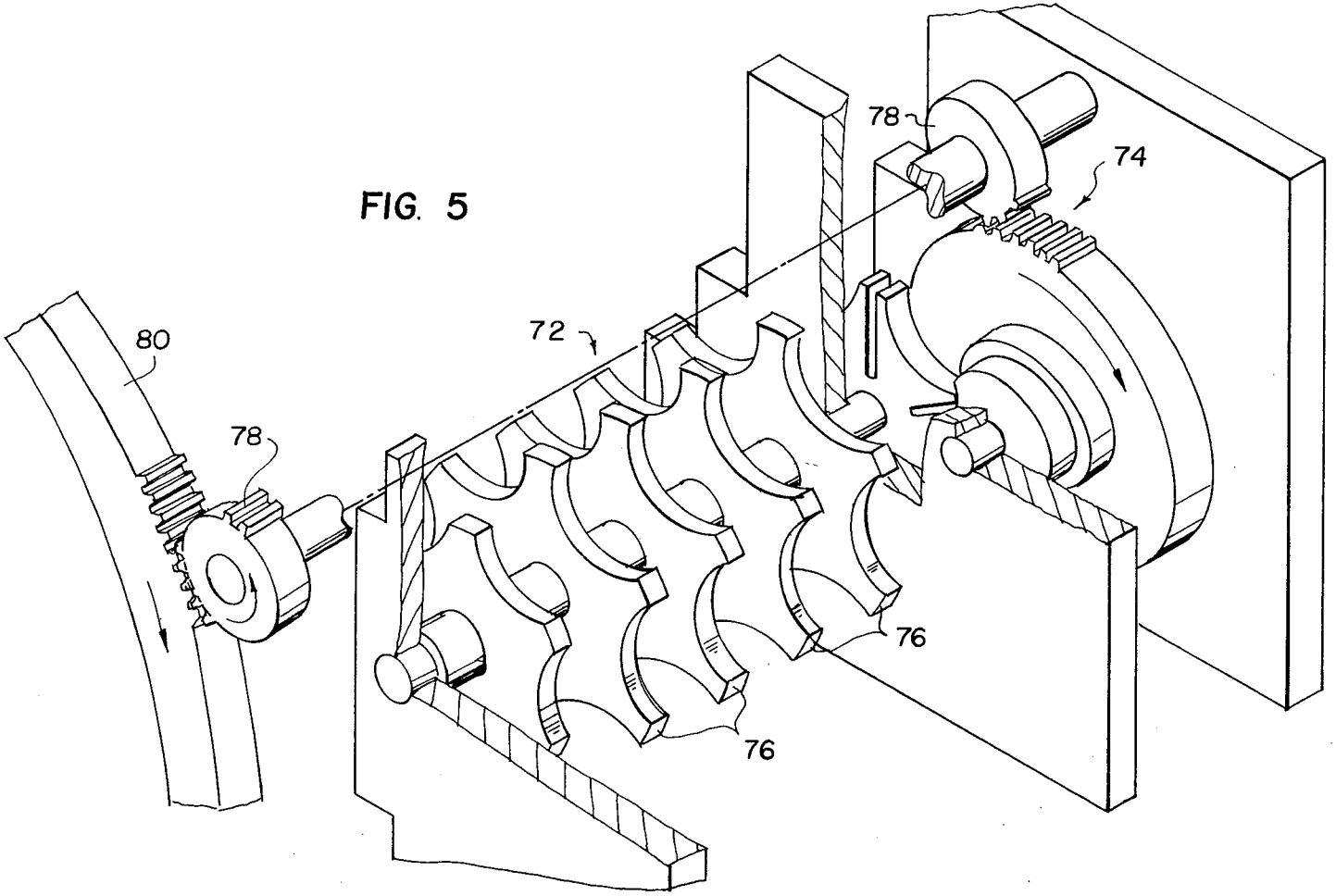
FIG. 5 is a top front perspective view of a propellant case feeder used in the embodiment of FIG. 2.

As shown in FIG. 5, case feeder means generally designated 72 include a Geneva gear mechanism generally designated 74 which intermittently rotates feed sprockets 76. The aligned curved recesses of sprocket 76 each cradle a separate propellant case to individually feed a propellant case into alignment with the forward end of chamber 22 when chamber member 20 is in its loading position. Geneva mechanism 74 is powered gears 78 one of which is engaged with a ring gear 80 fixed to cam drum 30. Since geneva mechanism 74 operates in known fashion, additional details are not here provided.

Sprockets 76 are rotated in synchronism with the movement of drive chain 60 and thus ram 64.

Figure 6:
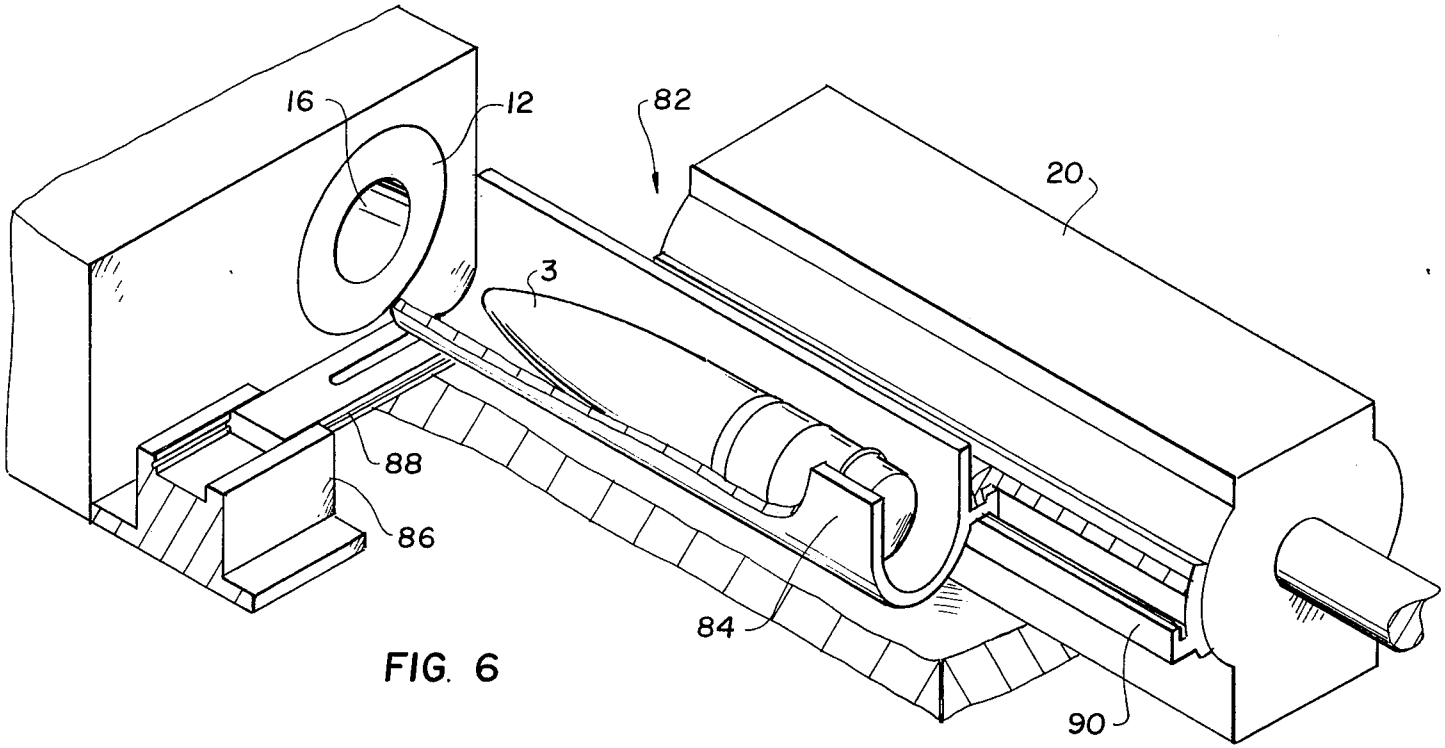
FIG. 6 is a top rear perspective view of a projectile feeder used in the embodiment of FIG. 2 showing the chamber in its loading and misaligned position with respect to the rear end opening of the barrel bore.

FIG. 6 illustrates projectile feeder means generally designated 82 which include a projectile carrier 84 which carry one projectile at a time from a vertical stack of projectiles to a position in alignment with the rear opening 16 of barrel 12 as shown in FIG. 6. Carrier 84 slides laterally on a slide block 86 fixed to receiver 18 and through a slider 88 longitudinally movable on carrier 84. Carrier 84 moves longitudinally with respect to chamber 20 on a rail 90 fixed to chamber 20. The lateral movement of chamber 20 thus automatically brings carrier 84 into alignment with rear opening 16, when chamber member 20 is in its loading position.

Figure 7:
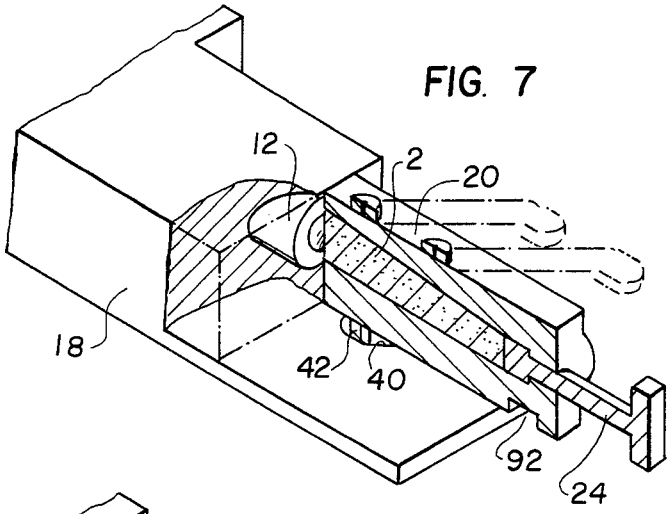
FIG. 7 is a top rear partial perspective view of the chamber, receiver and barrel in its firing position.
Figure 8:
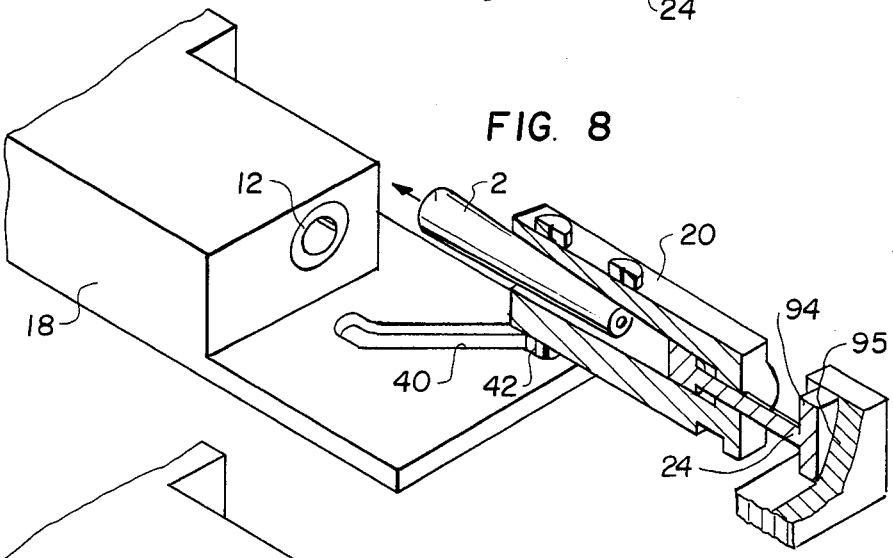
FIG. 8 is a view similar to FIG. 7 showing the chamber an instant before the loading position therefor with the spent propellant case being ejected.
Figure 9:
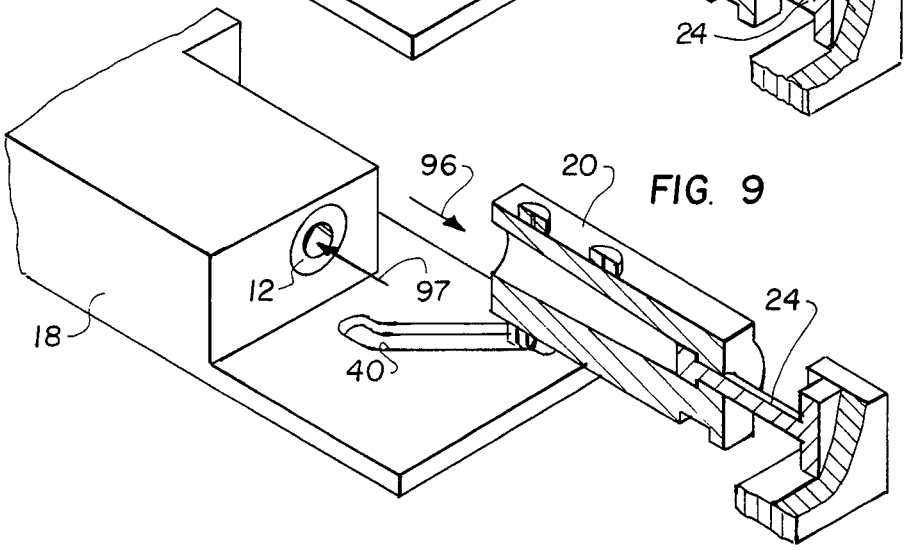
FIG. 9 is a view similar to FIG. 8 of the chamber in its loading position.

Referring now to FIGS. 7 through 9, one half cycle of the cannon mechanism is illustrated.

FIG. 7 illustrates the operating position for chamber member 20. In this position, cam follower 28 which is engaged in slot 92 at the bottom of chamber member 20, has pushed chamber member 20 up against the rear end of barrel 12 thereby crushing the rear end of a projectile in the barrel against the flange 9 of the propellant case 2. A firing pin (not shown) is released to ignite the propellant and eject the projectile from the barrel. A continued rotation of cam drum 30 causes chamber member 20 to move back approximately $\frac{1}{4}$ inch in cam groove 40. Additional cam grooves at the top of receiver 18 are shown in dotted lines in FIG. 7. Before chamber member 20 begins to move, however, a lobe on the cam drum 30 engages lock 26 and moves it to its unlocked position. The slight rearward movement of chamber member 20 breaks the seal formed between the barrel and chamber by detonation of the propellant charge. Continued rotation of cam drum 30 causes chamber member 20 to move laterally and then again rearwardly to the position shown in FIG. 8. The additional slight rearward movement of chamber member 20 causes a rectangular stop block 94 fixed to the end of bolt/ejector assembly 24 to engage a stop surface 95 of receiver 18. This causes a slight relative forward movement of ejector assembly 24 with respect to chamber member 20 which dislodges and ejects spent propellant case 2 as shown in FIG. 8.

As shown in FIG. 9, cam 30 then causes chamber member 20 to move slightly longitudinally forward to reset and at the same time recock a firing pin in bolt/ejector assembly 24. Arrows 96 and 97 show the direction of fresh case and projectile as they are reloaded. The continued rotation of cam drum 30 causes chamber member 20 to return to its position shown in FIG. 7 whereat the cannon is fired again.

Cam groove 32 in cam drum 30 is shaped to provide proper dwell times for the chamber member 20 during firing and loading. Releasing of the firing pin is accomplished by a cam action mechanism (not shown) which also operates from the movement of cam drum 30.

Referring now to FIGS. 10 through 16, an alternate form of the embodiment utilizes a projectile feeder which feeds projectiles from the left as viewed from the rear of the cannon mechanism, and cases from the top.

Figure 15:
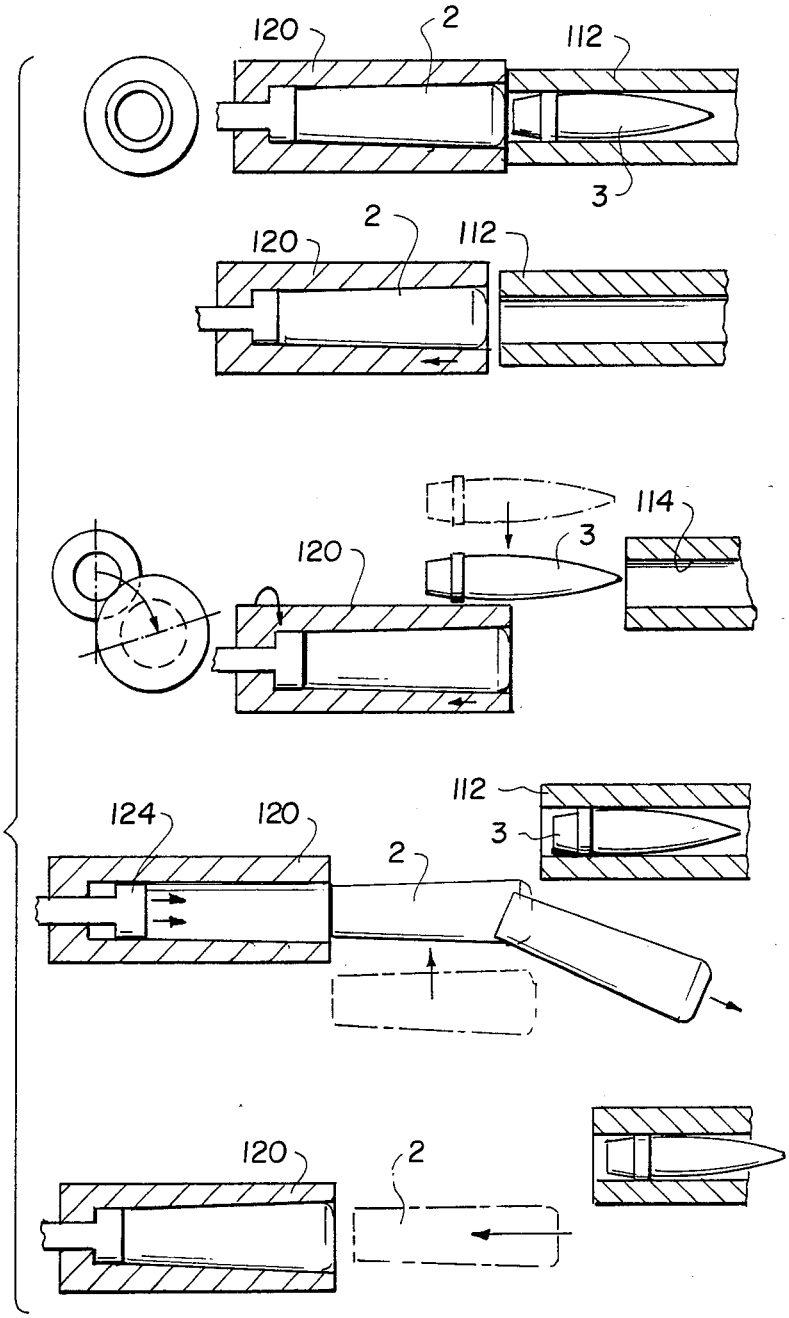
FIG. 15 is a composite view showing one complete cycle in the operation of the embodiment of FIG. 10.

FIG. 15 shows five relative positions between the barrel and chamber which, in this embodiment is moved longitudinally to the rear and rotated approximately 66° about an axis parallel to the barrel bore, for clearing the barrel bore.

The top views in FIG. 15 show the chamber member 120 in its operating position with respect to barrel 112. The second figure down shows the retreat to the left of chamber member 20 by $\frac{1}{4}$ inch to break the seal between case 2 and barrel 112. The third figure down shows the rotation of chamber member 120 by 66.25° which effectively clears barrel bore 114 to permit projectile ramming. The fourth figure down shows the ejection of a spent case 2 by ejector 124 which has engaged a stop (not shown) to move it forward with respect to chamber member 120. The bottom view of FIG. 15 shows the repositioning of chamber member 120 into its loading position for receiving a fresh case 2.

Figure 16:
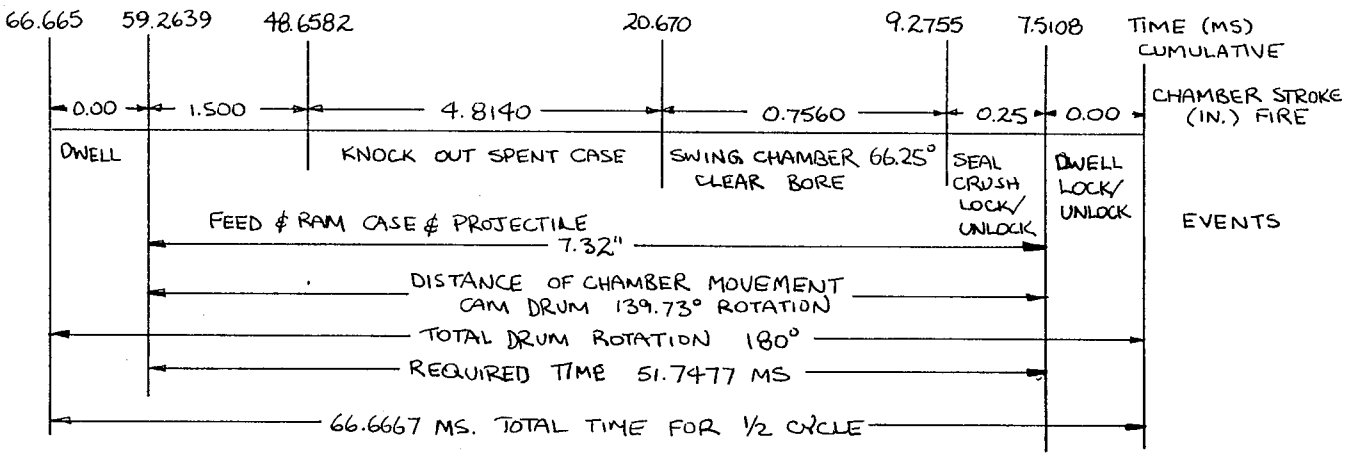
FIG. 16 is a graph illustrating times and distances during one half cycle for the cannon illustrated in FIGS. 10 through 15.

FIG. 16 shows the sequential steps of $\frac{1}{2}$ cycle (from the operating position to the loading position of chamber member 120) including distances moved by the chamber member and the time required for each phase.

The cannon mechanism constructed in accordance with the embodiments of FIG. 10 through 16 is in 30 mm caliber and is capable of operating at 450 shots per minute.

Figure 10:
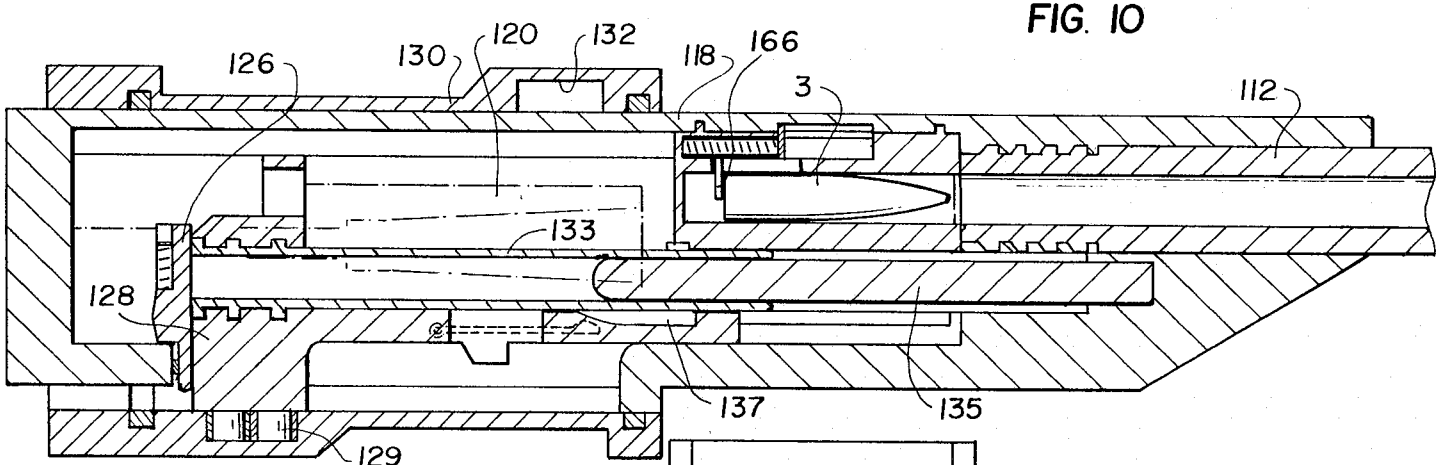
FIG. 10 is a side sectional view of another embodiment of the automatic cannon in accordance with the invention with the chamber in its unloaded position.

FIG. 10 illustrates the cannon mechanism with chamber member 20 in its loading position. Chamber member 20 is rotatable on a cam follower 128 which has a cam projection 129 movable in a groove 132 of cam drum 130. Cam drum 130 is rotatable on receiver 118.

Cam follower 128 includes a hollow tube 133 to which chamber member 120 is fixed and which rides on a fixed longitudinally extending post 135. A sliding block and secondary cam 137 effects rotation of chamber member 120. Lock 126, shown in its unlocked position in FIG. 10, is engaged by a lobe in cam drum 130 to lock chamber member 120 up against barrel 112 for firing of the projectile. Lock 126 is spring loaded so that it automatically falls into its unlocked position when chamber member 120 is moved into its loading position.

Figure 11:
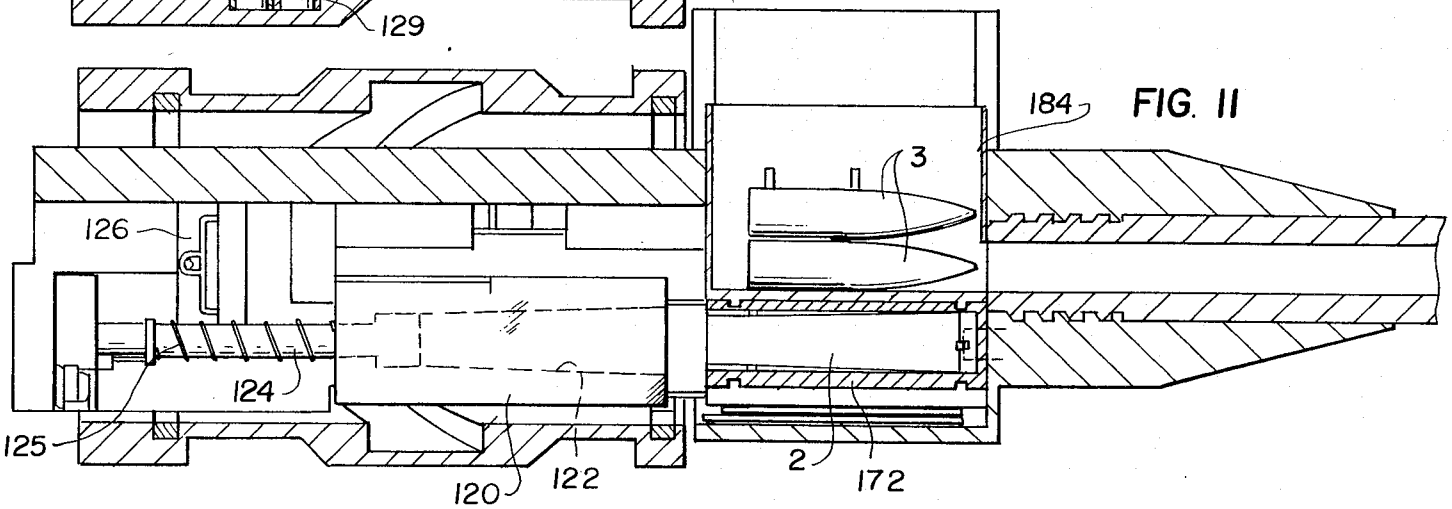
FIG. 11 is a top sectional view of the embodiment of FIG. 10.
Figure 12:
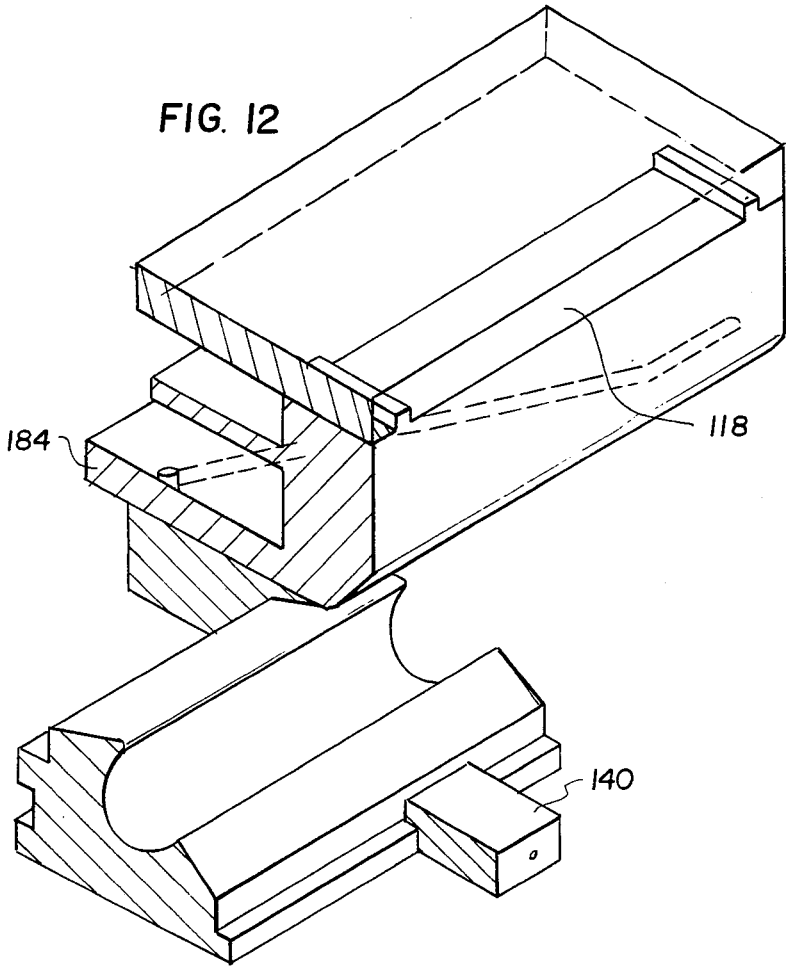
FIG. 12 is a partial top rear perspective view of the projectile feeder and rammer used in the embodiment of FIG. 10.

As shown in FIGS. 10–12, bolt/ejector assembly 124 includes a spring 125 for returning the bolt to its seated position in chamber 122 of chamber member 120 for receiving a fresh case 2 from case feeder 172. Projectiles 3 are lined up on a projectile carrier 184 and are rammed by a spring loaded projectile rammer 166. As shown in FIG. 11, projectile carrier 184 is slidably mounted in receiver 118 of the cannon assembly. Simultaneously with that movement, rammer 166 rams the next aligned projectile 3 into the rear end of the barrel bore.

Figure 13:
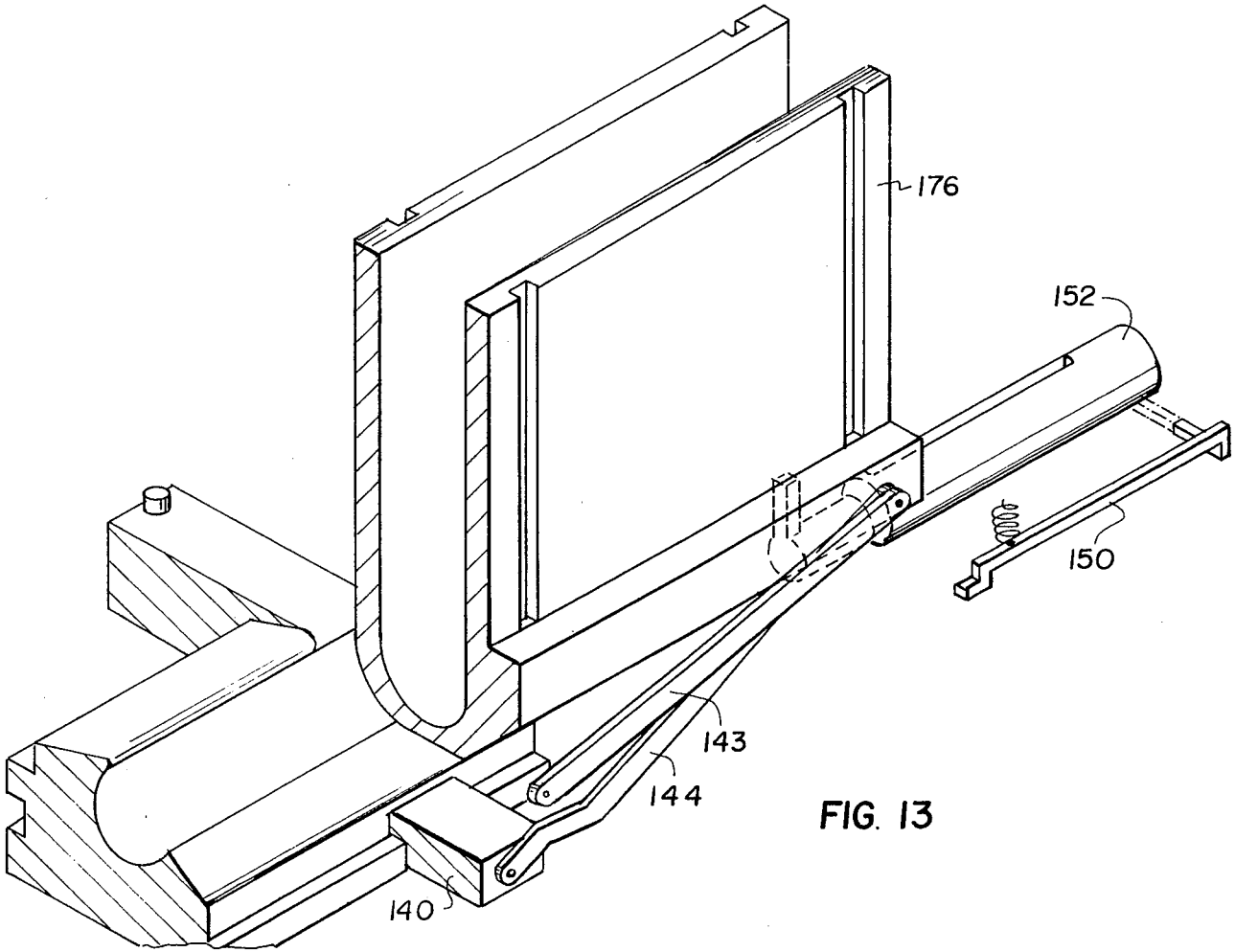
FIG. 13 is a partial top rear perspective view of the propellant case feeder and rammer used in the embodiment of FIG. 10.

FIG. 13 illustrates means for feeding and ramming the case which includes a case carrier 176 having a stack of cases (not shown) in FIG. 13.

The case feeder system is controlled by two linkages 143 and 144. Linkage 143 is pivotally connected to receiver 118 (not shown in FIG. 13) with linkage 144 connected to slider block 140. Both links 143 and 144 are connected to case carrier 176. This provides the relatively large (2.4 inches) lift of carrier 176 for a relatively small sliding movement (0.9 inches) of slider block 140. This also provides ample room for ejecting spent cases.

The rammer for the case feeder is separate from the carrier since sufficient room is available in the receiver for this purpose. The rammer is operated by a lever 150 which unlocks the rammer rod 152 when the carrier moves down into the loading position. The rammer is reloaded by the motion of the slide block 140.

Figure 14:
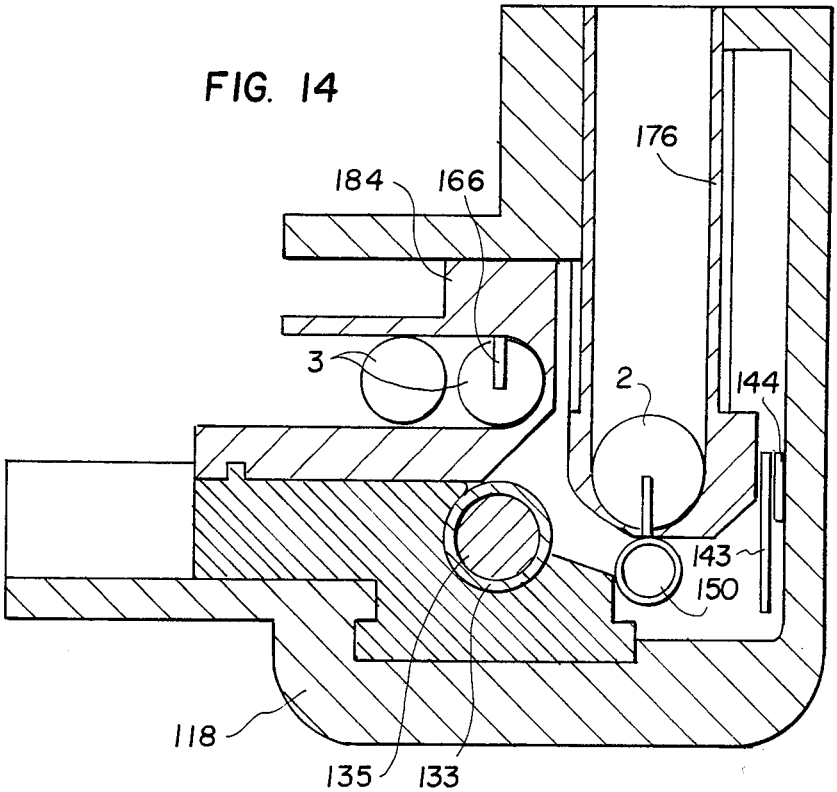
FIG. 14 is a rear sectional view of the projectile and case feeders and rammers used in the embodiment of FIG. 10.

FIG. 14 shows a rear sectional view of the projectile and case feeders with their associated rammers.

While specific embodiments of the invention have been shown and described in detail to illustrate the application of the principles of the invention, it will be understood that the invention may be embodied otherwise without departing from such principles.

What is claimed is:

1. An externally powered automatic cannon comprising:

a receiver;

a barrel connected to said receiver and having a bore with a rear end opening toward said receiver for receiving a projectile;

a chamber member having a chamber for receiving a propellant case and movable in said receiver from an operating position with said chamber aligned and communicating with said rear end opening of said barrel, to a loading position with said chamber misaligned with and spaced from said rear end opening;

projectile feed means for feeding a plurality of projectiles, one at a time, into alignment with said rear end opening;

projectile ram means for ramming a projectile which is in alignment with said rear end opening, into said rear end opening in a first direction;

case feed means for feeding a plurality of propellant cases, one at a time, into alignment with said chamber when said chamber member is in said loading position; case ram means for ramming a propellant case which is in alignment with said chamber, into said chamber in a second direction opposite to said first direction, when said chamber is in said loading position; and external drive means cyclically movable on said receiver and operatively engaged with said chamber member, said projectile ram means and said case ram means for moving said chamber member into said loading position, ramming a projectile and a case and returning said chamber member into said operating position during one cycle, said external drive means comprising a main cam drum rotatably mounted around said receiver and having a main cam groove therein, and a cam follower engaged with said chamber member having a portion projecting into said main cam groove for moving said chamber member between said operating and loading positions, said receiver further including at least one additional cam groove extending at least partially along a longitudinal axis of said cannon and at least partially at an angle to said longitudinal axis, said chamber member having a projection extending into said additional cam groove for moving said chamber member from said operating position to said loading position; and a bolt/ejector assembly slidably mounted to said chamber member having an end at a base of said member, and a stop formed in said receiver against which said bolt/ejector assembly engages as said chamber member moves past said loading position from said operating position through the movement of said main cam drum for displacing said bolt/ejector member with respect to said chamber member to dislodge and eject a spent propellant case from said chamber.

2. An externally powered automatic cannon comprising:

a receiver;

a barrel connected to said receiver and having a bore with a rear end opening toward said receiver for receiving a projectile;

a chamber member having a chamber for receiving a propellant case and movable in said receiver from an operating position with said chamber aligned and communicating with said rear end opening of said barrel, to a loading position with said chamber misaligned with and spaced from said rear end opening;

projectile feed means for feeding a plurality of projectiles, one at a time, into alignment with said rear end opening;

projectile ram means for ramming a projectile which is in alignment with said rear end opening, into said rear end opening in a first direction;

case feed means for feeding a plurality of propellant cases, one at a time, into alignment with said chamber when said chamber member is in said loading position; case ram means for ramming a propellant case which is in alignment with said chamber, into said chamber in a second direction opposite to said first direction, when said chamber is in said loading position; and external drive means cyclically movable on said receiver and operatively engaged with said chamber member, said projectile ram means and said case ram means for moving said chamber member into said loading position, ramming a projectile and a case and returning said chamber member into said operating position during one cycle, said external drive means comprising a cam drum rotatably mounted around said receiver and having a main cam groove therein, and a cam follower engaged with said chamber member having a portion projecting into said main cam groove for moving said chamber member between said operating and loading positions, said projectile and case ram means comprising chain means forming an endless loop movable on said receiver, said chain means having first and second legs extending substantially parallel to the longitudinal axis of said cannon, a slider cam follower, a slider cam groove defined in said cam drum engaged with said slider cam follower for reciprocately moving said slider cam follower, said slider cam follower operatively engaged with said chain means for moving said chain means, a projectile rammer connected to said first leg of said chain means and a case rammer connected to said leg of said chain means, said receiver having a slot for receiving each of said projectile and case rammers and permitting movement thereof with movement of said slider cam follower for ramming projectiles and cases.

3. An externally powered automatic cannon comprising:

a receiver;

a barrel connected to said receiver and having a bore with a rear end opening toward said receiver for receiving a projectile;

a chamber member having a chamber for receiving a propellant case and movable in said receiver from an operating position with said chamber aligned and communicating with said rear end opening of said barrel, to a loading position with said chamber misaligned with and spaced from said rear end opening;

projectile feed means for feeding a plurality of projectiles, one at a time, into alignment with said rear end opening; said projectile feed means comprising a projectile carrier slidably mounted in a direction parallel to a longitudinal axis of said cannon and to said chamber member, a slide block connected to said receiver and a slider slidably mounted transversely and longitudinally to a projectile carrier whereby said projectile carrier is moved into alignment with said rear end opening of said barrel bore when said chamber member is in said loading position;

projectile ram means for ramming a projectile which is in alignment with said rear end opening, into said rear end opening in a first direction;

case feed means for feeding a plurality of propellant cases, one at a time, into alignment with said chamber when said chamber member is in said loading position; case ram means for ramming a propellant case which is in alignment with said chamber, into said chamber in a second direction opposite to said first direction, when said chamber is in said loading position; and external drive means cyclically movable on said receiver and operatively engaged with said chamber member, said projectile ram means and said case ram means for moving said chamber member into said loading position, ramming a projectile and a case and returning said chamber member into said operating position during one cycle, said external drive means comprising a cam drum rotatably mounted around said receiver and having a main cam groove therein, and a cam follower engaged with said chamber member having a portion projecting into said main cam groove for moving said chamber member between said operating and loading positions.

* * * * *

UNITED STATES PATENT AND TRADEMARK OFFICE

CERTIFICATE OF CORRECTION

PATENT NO. : 4,548,120

DATED : October 22, 1985

INVENTOR(S) : Ladd Yuhash, et al.

It is certified that error appears in the above-identified patent and that said Letters Patent is hereby corrected as shown below:

On the title page inventors should read

-- (75) inventors: Ladd Yuhash, Budd Lake, N.J. Deceased; By Salvatore Spignee; Lexington, MA., Executor; Richard Ciekurş, New Providence, N.J. --.

Signed and Sealed this

*Fifth* Day of *August 1986*

[SEAL]

*Attest:*

*Attesting Officer*

DONALD J. QUIGG

*Commissioner of Patents and Trademarks*